US008488984B2

(12) United States Patent
Ohkawa et al.

(10) Patent No.: US 8,488,984 B2
(45) Date of Patent: Jul. 16, 2013

(54) TONER CONCENTRATION CONTROLLER AND IMAGE FORMING APPARATUS INCLUDING THE TONER CONCENTRATION CONTROLLER

(75) Inventors: Takeshi Ohkawa, Osaka (JP); Kiyofumi Morimoto, Osaka (JP); Kohichi Takenouchi, Osaka (JP); Masayasu Narimatsu, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 249 days.

(21) Appl. No.: 13/039,533

(22) Filed: Mar. 3, 2011

(65) Prior Publication Data

US 2011/0229156 A1 Sep. 22, 2011

(30) Foreign Application Priority Data

Mar. 19, 2010 (JP) ..... 2010-064540

(51) Int. Cl.
*G03G 15/08* (2006.01)

(52) U.S. Cl.
USPC ..... 399/62

(58) Field of Classification Search
USPC ..... 399/27, 30, 58, 61, 62, 63, 258, 50, 399/55
See application file for complete search history.

(56) References Cited

U.S. PATENT DOCUMENTS

| | | | | |
|---|---|---|---|---|
| 6,377,762 | B2 * | 4/2002 | Kobayashi et al. | 399/46 |
| 7,333,739 | B2 * | 2/2008 | Miyata | 399/27 |
| 7,983,577 | B2 * | 7/2011 | Kita et al. | 399/27 |
| 2004/0057755 | A1 | 3/2004 | Yamaguchi et al. | |
| 2009/0220266 | A1 | 9/2009 | Shiraishi et al. | |

FOREIGN PATENT DOCUMENTS

| | | | | |
|---|---|---|---|---|
| JP | 61034569 | A | * | 2/1986 |
| JP | 4-110970 | A | | 4/1992 |
| JP | 4-242766 | A | | 8/1992 |
| JP | 05323787 | A | * | 12/1993 |
| JP | 9-269646 | A | | 10/1997 |
| JP | 2004-117507 | A | | 4/2004 |
| JP | 2006-106194 | A | | 4/2006 |
| JP | 2009-222944 | A | | 10/2009 |
| JP | 2010-2537 | A | | 1/2010 |

* cited by examiner

*Primary Examiner* — Robert Beatty
(74) *Attorney, Agent, or Firm* — Birch, Stewart, Kolasch & Birch, LLP

(57) ABSTRACT

An image forming apparatus includes: a developing device; a toner supply device; and a toner supply detecting sensor; and a toner concentration controller that directs toner supply. The toner concentration controller includes: a memory that stores the difference between the outputs from toner supply detecting sensor before and after toner supply; a toner supply quantity determinater that determines that the amount of toner remaining in the toner supply device is low and the amount of toner supply is low when the output difference or output ratio of the sensor is lower than a supply reference value; and an image quality adjustment controller that shortens the interval of time between adjustment of electrical potential on toner concentration correction in the above case.

7 Claims, 9 Drawing Sheets

TONER CONCENTRATION CONTROLLER AND IMAGE FORMING APPARATUS INCLUDING THE TONER CONCENTRATION CONTROLLER

This Nonprovisional application claims priority under 35 U.S.C. §119(a) on Patent Application No. 2010-64540 filed in Japan on 19 Mar. 2010, the entire contents of which are hereby incorporated by reference.

BACKGROUND OF THE INVENTION (1) Field of the Invention

The present invention relates to an image forming apparatus, in particular, relates to an image forming apparatus such as an electrostatic copier, laser printer, facsimile machine or the like that includes a developing device using a dual-component developer containing a toner and a magnetic carrier and forms images using toner based on electrophotography.

(2) Description of the Related Art

Conventionally, image forming apparatuses based on electrophotography such as copiers, printers, facsimile machines and the like have been known. The image forming apparatus using electrophotography is constructed so as to form an image by forming an electrostatic latent image on the surface of a photoreceptor, e.g., photoreceptor drum, supplying toner to the photoreceptor drum from a developing device to develop the electrostatic latent image, transferring the toner image formed on photoreceptor drum by development to a sheet of paper etc., and fixing the toner image onto the sheet by means of a fixing device.

Recently, in the image forming apparatuses supporting full-color and/or high-quality images, a dual-component developer (which will be referred to hereinbelow simply as "developer"), which presents excellent charge performance stability, is often used.

This developer consists of a toner and a carrier, which are agitated in the developing device and frictionally rubbed with each other to thereby produce appropriately electrified toner.

The electrified toner in the developing device is supplied to a dual-component developer supporting member, e.g., the surface of a developing roller. The toner thus supplied to the developing roller is moved by electrostatic attraction to the electrostatic latent image formed on the photoreceptor drum. Hereby, a toner image based on the electrostatic latent image is formed on the photoreceptor drum.

Further, recently, image forming apparatuses are demanded to be made compact and operate at high speeds, hence it has become necessary to electrify the developer quickly and sufficiently and also convey the developer quickly and smoothly.

For this purpose, in order to disperse supplied toner promptly into the developer and provide the toner with an appropriate amount of charge, a circulating type developing device has been adopted in some image forming apparatuses.

This circulating type developing device includes: a developer conveying passage in which the developer is circulatively conveyed; a screw auger (developer conveying member) for conveying the developer while agitating the developer in the developer conveying passage; a toner supply port for leading toner from a toner container into the developer conveying passage; and a toner concentration detecting sensor for detecting the toner concentration in the developer. In this arrangement, when the toner concentration in the developer is lower than a predetermined level, a toner supply command is given to the toner cartridge so that toner is supplied to the developer conveying passage and the supplied toner is conveyed whilst being agitated (see Patent Document 1).

There is also another disclosure of an image forming apparatus including: a mechanism in which "a comparison is made between the output value from a toner concentration sensor before the supplied toner reaches the toner concentration sensor and the output value from the toner concentration sensor after the supplied toner has reached the toner concentration sensor, and it is determined that no toner remains when the output difference becomes lower than a predetermined value"; and another mechanism in which "the toner supply time and the number of times of toner supply is varied depending on the number of times no toner is determined to remain", and being constructed such that the interval of modifying the image forming conditions for preventing reduction in image density is shortened by comparing the reduction in toner concentration to a previously predicted and predetermined value to thereby maintain image density continually (see Patent Document 2).

Patent Document 1:

Japanese Patent Application Laid-open 2006-106194

Patent Document 2:

Japanese Patent Application Laid-open Hei 9 No. 269646

In the aforementioned circulating type developing device using the dual-component developer, if toner to be supplied from the toner cartridge to the developing device is used up, the toner concentration in the developer gradually decreases. Since the occurrence of carrier phenomena (carrier adherence) to the photoreceptor drum increases with the decrease of toner concentration, it is necessary to perform toner empty detection.

Toner empty detection is to determine (detect) the occurrence of a toner empty state when, for example, the toner concentration of the developer in the developing device, detected by the toner supply detecting sensor does not increase even after a toner supply command was given to the toner cartridge.

However, in the case where no toner is supplied even after a toner supply command was given to the toner cartridge because of toner empty in the toner cartridge, if the toner concentration detecting sensor is located away from the toner supply port through which toner is supplied, detection of toner empty is delayed because the fall of toner concentration detected by the toner concentration detecting sensor is sluggish. As a result, there occurs the problem that the occurrence of carrier adherence becomes more frequent.

Further, there is also a problem that if the amount of toner to be supplied is low, the density of the toner image formed on the paper etc. becomes lowered even before toner empty is detected.

SUMMARY OF THE INVENTION

The present invention has been devised in view of the above problems, it is therefore an object of the present invention to provide an image forming apparatus that can exactly detect an empty state of toner to be supplied to the developing device, or a state of toner being reduced to a low level and can prevent occurrence of carrier adherence to the photoreceptor and lowering of image density due to decrease in toner concentration.

It is another object of the present invention to provide an image forming apparatus that can prevent lowering of the density of the toner image formed on the paper etc., even before toner empty is detected.

The image forming apparatus according to the present invention for solving the above problem is configured as follows:

The first aspect of the present invention resides in an image forming apparatus comprising: a developing device; a toner supply device; a toner supply detecting sensor; and a toner concentration controller, characterized in that the developing device comprises: a developer container for storing a developer including a toner and a magnetic carrier; a developer conveying structure disposed inside the developer container for circulatively conveying the developer whilst agitating; a developing roller for supplying the toner included in the developer to a photoreceptor drum; and a toner supply port that leads supplied toner into the developer container, the toner supply device supplies the toner into the developing device, the toner supply detecting sensor detects whether the toner has been supplied into the developer container, the toner concentration controller instructs the toner supply device to supply toner to the developing device when the toner concentration of the developer in the developing device has become lower than a predetermined reference concentration, the toner concentration controller determines that the toner in the toner supply device is empty when toner supply detecting sensor has detected no toner supply after a command of toner supply was given, as a toner supply quantity evaluation index, the toner concentration controller includes: a memory that stores either the difference, or the ratio, between the outputs from toner supply detecting sensor before and after toner supply from the toner supply device; a toner supply quantity determinater that determines whether the toner supply quantity evaluation index is smaller than a predetermined supply reference value; and an image quality adjustment controller that shortens the interval of time between adjustment of electrical potential associated with toner concentration correction when the toner supply quantity evaluation index is smaller than the supply standard value.

The second aspect of the present invention is characterized in that the image quality adjustment controller shortens the interval of time between adjustments of electrical potential when the average of a plurality of toner supply quantity evaluation indexes is smaller than the supply reference value or when a plurality of toner supply quantity evaluation indexes are smaller than the supply reference value.

According to the third aspect of the present invention, it is preferable that the toner supply detecting sensor is disposed near the toner supply port in the developer container.

According to the fourth aspect of the present invention, it is preferable that a magnetic permeability sensor that detects the magnetic permeability of the developer in the developer container is used as the toner supply detecting sensor.

According to the fifth aspect of the present invention, it is preferable that the developing device includes a first conveying passage and a second conveying passage that are sectioned by a partitioning wall and arranged to communicate with each other at both ends of the partitioning wall, the developer conveying structure includes a first conveying member and a second conveying member that are arranged in the first convening passage and second conveying passage, respectively, agitate and circulatively convey the developer in the first conveying passage and in the second conveying passage, in opposite directions to each other, the developing device supplies the developer inside the second conveying passage to the photoreceptor drum by means of the developing roller, the toner supply port is disposed over the first conveying passage, and the toner supply detecting sensor is disposed at the bottom of the first conveying passage under the toner supply port.

According to the sixth aspect of the present invention, it is preferable that the first conveying member employs a screw auger having a rotary shaft and a helical blade, and the helical blade is formed so that the inclined angle relative to the axial direction of the rotary shaft (the angle formed between the rotary shaft and the outer peripheral edge of the helical blade when the rotary shaft is viewed along the axis) is specified to fall within the range of 30 degrees to 60 degrees.

According to the seventh aspect of the present invention, it is preferable that the image forming apparatus further includes a dot counter for counting dots of data corresponding to image data to be transmitted to the exposure device (e.g., laser scanner unit) for forming an electrostatic latent image on the photoreceptor drum surface, and the toner concentration controller instructs the toner supply device to supply toner to the developing device based on the count of the dots of data from the dot counter.

For example, when the number of dots of data counted by the dot counter is small, the toner concentration controller may instruct the toner supply device to supply a small amount of toner to the developing device. When a large number of dots of data are counted, the controller may instruct the toner supply device to supply a large amount of toner to the developing device. It is preferable that the amount of toner to be supplied has been specified in advance in relation with the condition of dots of data.

According to the first aspect of the present invention, the states in which no or little toner is left in the toner supply device can be exactly detected. When the amount of toner supply has becomes low as a result of reduction of the amount of residual toner, the potential adjustment on toner concentration correction is performed in conformity with the amount of toner supply, whereby it is possible to inhibit lowering of image density.

Further, according to the second aspect of the present invention, it is possible to perform a process control at the optimal timing in conformity with the amount of toner supply.

According to the third aspect of the present invention, since the toner supply detecting sensor detects presence or absence of toner supply immediately after giving a toner supply command to the toner supply device, it is possible to detect toner empty at once when toner in the toner supply device is lowered or used up and hence prevent occurrence of carrier adherence due to a decrease in toner concentration and occurrence of carrier adherence due to lowering of toner concentration.

According to the fourth aspect of the present invention, it is possible to easily detect the effect of toner supply by detecting change in toner concentration.

According to the fifth aspect of the present invention, the effect of toner supply can be detected with precision. Specifically, since the pressure on the developer becomes maximum at the bottom of the first conveying passage, voids are unlikely to form inside the developer. Accordingly it is possible to precisely detect the effect of toner supply with the toner supply detecting sensor.

According to the sixth aspect of the present invention, since the force for agitating the developer in the rotational direction of the first conveying member can be enhanced so that floating toner, or the added toner being conveyed floating over the developer, is unlikely to occur, it is possible for the toner supply detecting sensor to precisely detect the effect of toner supply.

According to the seventh aspect of the present invention, since it is possible to perform toner supply in a more exact manner compared to toner concentration control based on the toner concentration detected by the toner concentration detecting sensor, it is possible to perform toner concentration control and detection of toner empty, more precisely.

DETAILED DESCRIPTION OF THE INVENTION

Now, the embodied mode for carrying out the present invention will be described with reference to the drawings.

Figure 1:
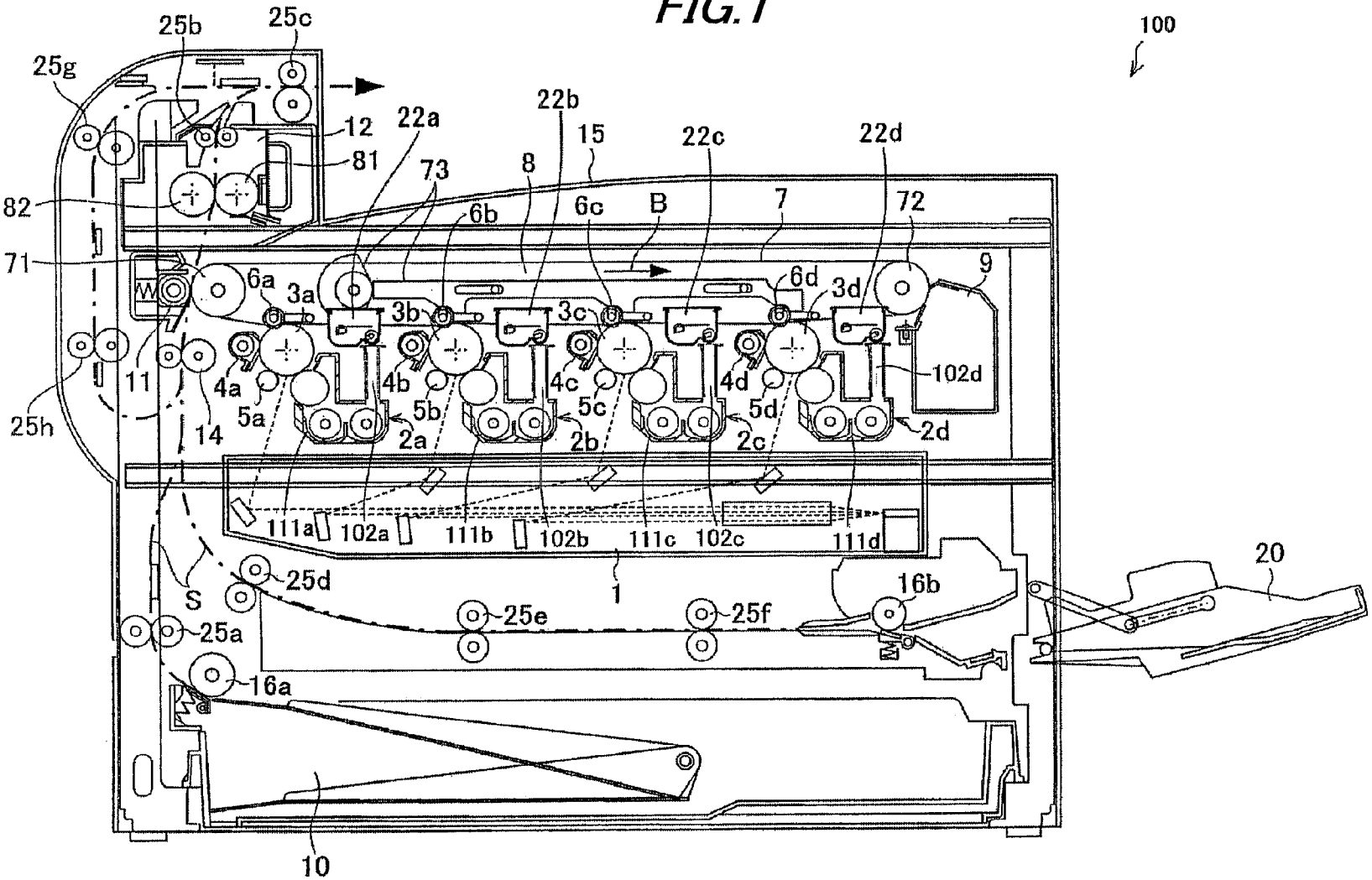
FIG. 1 is an illustrative view showing the overall configuration of an image forming apparatus according to the embodiment of the present invention.

FIG. 1 shows one exemplary embodiment of the present invention, and is an illustrative view showing the overall configuration of an image forming apparatus 100 according to the embodiment of the present invention.

Image forming apparatus 100 of the present embodiment forms an image with toners based on electrophotography, including: as shown in FIG. 1, photoreceptor drums 3*a*, 3*b*, 3*c* and 3*d* (which may be also called "photoreceptor drums 3" when general mention is made) for forming electrostatic latent images on the surfaces thereof; chargers (charging devices) 5*a*, 5*b*, 5*c* and 5*d* (which may be also called "chargers 5" when general mention is made) for charging the surfaces of photoreceptor drums 3; an exposure unit (exposure device) 1 for forming electrostatic latent images on the photoreceptor drum 3 surfaces; developing devices 2*a*, 2*b*, 2*c* and 2*d* (which may be also called "developing devices 2" when general mention is made) for supplying toners to the electrostatic latent images on the photoreceptor drum 3 surfaces to form toner images; toner supply devices 22*a*, 22*b*, 22*c* and 22*d* (which may be also called "toner supply devices 22" when general mention is made) for supplying toners to developing devices 2; an intermediate transfer belt unit (transfer device) 8 for transferring the toner images from the photoreceptor drum 3 surfaces to a recording medium; and a fixing unit (fixing device) 12 for fixing the toner image to the recording medium.

This image forming apparatus 100 forms a multi-color or monochrome image on a predetermined sheet (recording paper, recording medium) in accordance with image data transmitted from the outside. Here, image forming apparatus 100 may also include a scanner or the like on the top thereof.

To begin with, the overall configuration of image forming apparatus 100 will be described.

As shown in FIG. 1, image forming apparatus 100 separately handles image data of individual color components, i.e., black (K), cyan (C), magenta (M) and yellow (Y), and forms black, cyan, magenta and yellow images, superimposing these images of different color components to produce a full-color image.

Accordingly, image forming apparatus 100 includes, as shown in FIG. 1, four developing devices 2 (2*a*, 2*b*, 2*c* and 2*d*), four photoreceptor drums 3 (3*a*, 3*b*, 3*c* and 3*d*), four chargers 5 (5*a*, 5*b*, 5*c* and 5*d*) and four cleaner units 4 (4*a*, 4*b*, 4*c* and 4*d*) to form images of four different colors. In other words, four image forming stations (image forming portions) each including one developing device 2, one photoreceptor drum 3, one charger 5 and one cleaner unit 4 are provided.

Here, the symbols a to d are used so that 'a' represents the components for forming black images, 'b' the components for forming cyan images, 'c' the components for forming magenta images and 'd' the components for forming yellow images. Image forming apparatus 100 includes exposure unit 1, fixing unit 12, a sheet conveyor system S and a paper feed tray 10 and a paper output tray 15.

Charger 5 is applied with a charging bias (charging potential) to electrify the photoreceptor drum 3 surface at a predetermined potential.

Charger 5 functions to control the amount of toner to be supplied to the photoreceptor drum 3 surface by adjusting the charging bias, whereby it is possible to control the density of a toner image formed on a recording medium such as paper or the like.

As charger 5, other than the contact roller-type charger shown in FIG. 1, a contact brush-type charger, a non-contact type discharging type charger and others may be used.

Exposure unit 1 is a laser scanning unit (LSU) including a laser emitter and reflection mirrors as shown in FIG. 1. Other than the laser scanning unit, arrays of light emitting elements such as EL (electroluminescence) and LED writing heads, may be also used as exposure unit 1. Exposure unit 1 illuminates the photoreceptor drums 3 that have been electrified, in accordance with input image data so as to form electrostatic latent images corresponding to the image data on the surfaces of photoreceptor drums 3.

Developing device 2 is applied with a developing potential (developing bias) for visualizing (developing) the electrostatic latent image formed on photoreceptor drum 3 with toner of K, C, M or Y. Arranged over developing devices 2 (2*a*, 2*b*, 2*c* and 2*d*) are toner transport mechanisms 102 (102*a*, 102*b*, 102*c* and 102*d*), toner supply devices 22 (22*a*, 22*b*, 22*c* and 22*d*) and developing vessels (developer containers) 111 (111*a*, 111*b*, 111*c* and 111*d*).

Toner supply device 22 is arranged on the upper side of developing vessel 111 and stores unused toner (powdery toner). This unused toner is supplied from toner supply device 22 to developing vessel 111 by means of toner transport mechanism 102.

Cleaner unit 4 removes and collects the toner remaining on the photoreceptor drum 3 surface after development and image transfer steps.

Arranged over photoreceptor drums 3 is an intermediate transfer belt unit 8. Intermediate transfer belt unit 8 includes intermediate transfer rollers 6 (6*a*, 6*b*, 6*c* and 6*d*), an intermediate transfer belt 7, an intermediate transfer belt drive roller 71, an intermediate transfer belt driven roller 72, an intermediate transfer belt tensioning mechanism 73 and an intermediate transfer belt cleaning unit 9.

Intermediate transfer rollers 6, intermediate transfer belt drive roller 71, intermediate transfer belt driven roller 72 and intermediate transfer belt tensioning mechanism 73 support and tension intermediate transfer belt 7 to circulatively drive intermediate transfer belt 7 in the direction of an arrow B in FIG. 1.

Intermediate transfer rollers 6 are rotatably supported at intermediate transfer roller fitting portions in intermediate transfer belt tensioning mechanism 73. Applied to each intermediate transfer roller 6 is a transfer bias for transferring the toner image from photoreceptor drum 3 to intermediate transfer belt 7.

Intermediate transfer belt 7 is arranged so as to be in contact with each photoreceptor drum 3. The toner images of different color components formed on photoreceptor drums 3 are successively transferred one over another to intermediate transfer belt 7 so as to form a full-color toner image (multi-color toner image). This intermediate transfer belt 7 is formed of an endless film of about 100 to 150 μm thick, for instance.

Transfer of the toner image from photoreceptor drum 3 to intermediate transfer belt 7 is effected by intermediate transfer roller 6 which is put in contact with the interior side of intermediate transfer belt 7. A high-voltage transfer bias (a high voltage of a polarity (+) opposite to the polarity (−) of the electrostatic charge on the toner) is applied to each intermediate transfer roller 6 in order to transfer the toner image.

Intermediate transfer roller 6 is composed of a shaft formed of metal (e.g., stainless steel) having a diameter of 8 to 10 mm and a conductive elastic material (e.g., EPDM, foamed urethane, etc., coated on the shaft surface. Use of this conductive elastic material enables intermediate transfer roller 6 to uniformly apply high voltage to intermediate transfer belt 7. Though in the present embodiment, roller-shaped elements (intermediate transfer rollers 6) are used as the transfer electrodes, brushes etc. can also be used in place.

The electrostatic latent image formed on each of photoreceptor drums 3 is developed as described above with the toner associated with its color component into a visual toner image. These toner images are laminated on intermediate transfer belt 7, laying one image over another. The thus formed lamination of toner images is conveyed by rotation of intermediate transfer belt 7 to the contact position (transfer position) between the conveyed paper and intermediate transfer belt 7, and is transferred to the paper by a transfer roller 11 arranged at that position. In this case, intermediate transfer belt 7 and transfer roller 11 are pressed against each other forming a predetermined nip while a voltage for transferring the toner image to the paper is applied to transfer roller 11. This voltage is a high voltage of a polarity (+) opposite to the polarity (−) of the electrostatic charge on the toner.

In order to keep the aforementioned nip constant, either transfer roller 11 or intermediate transfer belt drive roller 71 is formed of a hard material such as metal or the like while the other is formed of a soft material such as an elastic roller or the like (elastic rubber roller, foamed resin roller etc.).

Of the toner adhering to intermediate transfer belt 7 as the belt comes into contact with photoreceptor drums 3, the toner which has not been transferred from intermediate transfer belt 7 to the paper during transfer of the toner image and remains on intermediate transfer belt 7 would cause contamination of color toners at the next operation, hence is removed and collected by intermediate transfer belt cleaning unit 9.

Intermediate transfer belt cleaning unit 9 includes a cleaning blade (cleaning member) that is put in contact with intermediate transfer belt 7. Intermediate transfer belt 7 is supported from its interior side by intermediate transfer belt driven roller 72, at the area where this cleaning blade is put in contact with intermediate transfer belt 7.

Paper feed tray 10 is to stack sheets (e.g., recording paper) to be used for image forming and is disposed under the image forming portion and exposure unit 1. On the other hand, paper output tray 15 disposed at the top of image forming apparatus 100 stacks printed sheets facedown.

Image forming apparatus 100 also includes sheet conveyor system S for guiding sheets from paper feed tray 10 and from a manual feed tray 20 to paper output tray 15 by way of the transfer portion and fixing unit 12. Here, the transfer portion is located between intermediate transfer belt drive roller 71 and transfer roller 11.

Arranged along sheet conveyor system S are pickup rollers 16 (16*a*, 16*b*), a registration roller 14, the transfer portion, fixing unit 12 and feed rollers 25 (25*a* to 25*h*) and the like.

Feed rollers 25 are a plurality of small-diametric rollers arranged along sheet conveyor system S to promote and assist sheet conveyance. Pickup roller 16*a* is a roller disposed at the end of paper feed tray 10 for picking up and supplying the paper one sheet at a time from paper feed tray 10 to sheet conveyor system S. Pickup roller 16*b* is a roller disposed at the vicinity of manual feed tray 20 for picking up and supplying the paper, one sheet at a time, from manual feed tray 20 to sheet conveyor system S. Registration roller 14 temporarily suspends the sheet being conveyed on sheet conveyor system S and delivers the sheet to the transfer portion at such timing that the front end of the sheet meets the front end of the toner image on intermediate transfer belt 7.

Fixing unit 12 includes a heat roller 81, a pressing roller 82 and the like. These heat roller 81 and pressing roller 82 rotate while nipping the sheet therebetween. Heat roller 81 is controlled by a controller 32 (FIG. 8) so as to keep a predetermined fixing temperature. This controller 32 controls the temperature of heat roller 81 based on the detection signal from a temperature detector (not shown).

Heat roller 81 fuses, mixes and presses the lamination of color toner images transferred on the sheet by thermally pressing the sheet with pressing roller 82 so as to thermally fix the toner onto the sheet. The sheet with a multi-color toner image (a single color toner image) fixed thereon is conveyed by plural feed rollers 25 to the inversion paper discharge path of sheet conveyor system S and discharged onto paper output tray 15 in an inverted position (with the multi-color toner image placed facedown).

Next, the operation of sheet conveyance by sheet conveyor system S will be described.

As shown in FIG. 1, image forming apparatus 100 has paper feed tray 10 that stacks sheets beforehand and manual feed tray 20 that is used when a few pages are printed out. Each tray is provided with pickup roller 16 (16*a*, 16*b*) so that these pickup rollers 16 supply the paper one sheet at a time to sheet conveyor system S.

In the case of one-sided printing, the sheet conveyed from paper feed tray 10 is conveyed by feed roller 25*a* in sheet conveyor system S to registration roller 14 and delivered to the transfer portion (the contact position between transfer roller 11 and intermediate transfer belt 7) by registration roller 14 at such timing that the front end of the sheet meets the front end of the image area including a lamination of toner images on intermediate transfer belt 7. At the transfer portion, the toner image is transferred onto the sheet. Then, this toner image is fixed onto the sheet by fixing unit 12. Thereafter, the sheet passes through a feed roller 25*b* to be discharged by a paper output roller 25*c* onto paper output tray 15.

Also, the sheet conveyed from manual feed tray 20 is conveyed by plural feed rollers 25 (25*f*, 25*e* and 25*d*) to registration roller 14. From this point, the sheet is conveyed and discharged to paper output tray 15 through the same path as that of the sheet fed from the aforementioned paper feed tray 10.

On the other hand, in the case of dual-sided printing, the sheet having been printed on the first side and passed through fixing unit 12 as described above is nipped at its rear end by paper discharge roller 25*c*. Then the paper discharge roller 25*c* is rotated in reverse so that the sheet is guided to feed rollers 25*g* and 25*h*, and conveyed again through registration roller 14 so that the sheet is printed on its rear side and then discharged to paper output tray 15.

Next, the configuration of toner supply device 22 will be specifically described.

Figure 2:
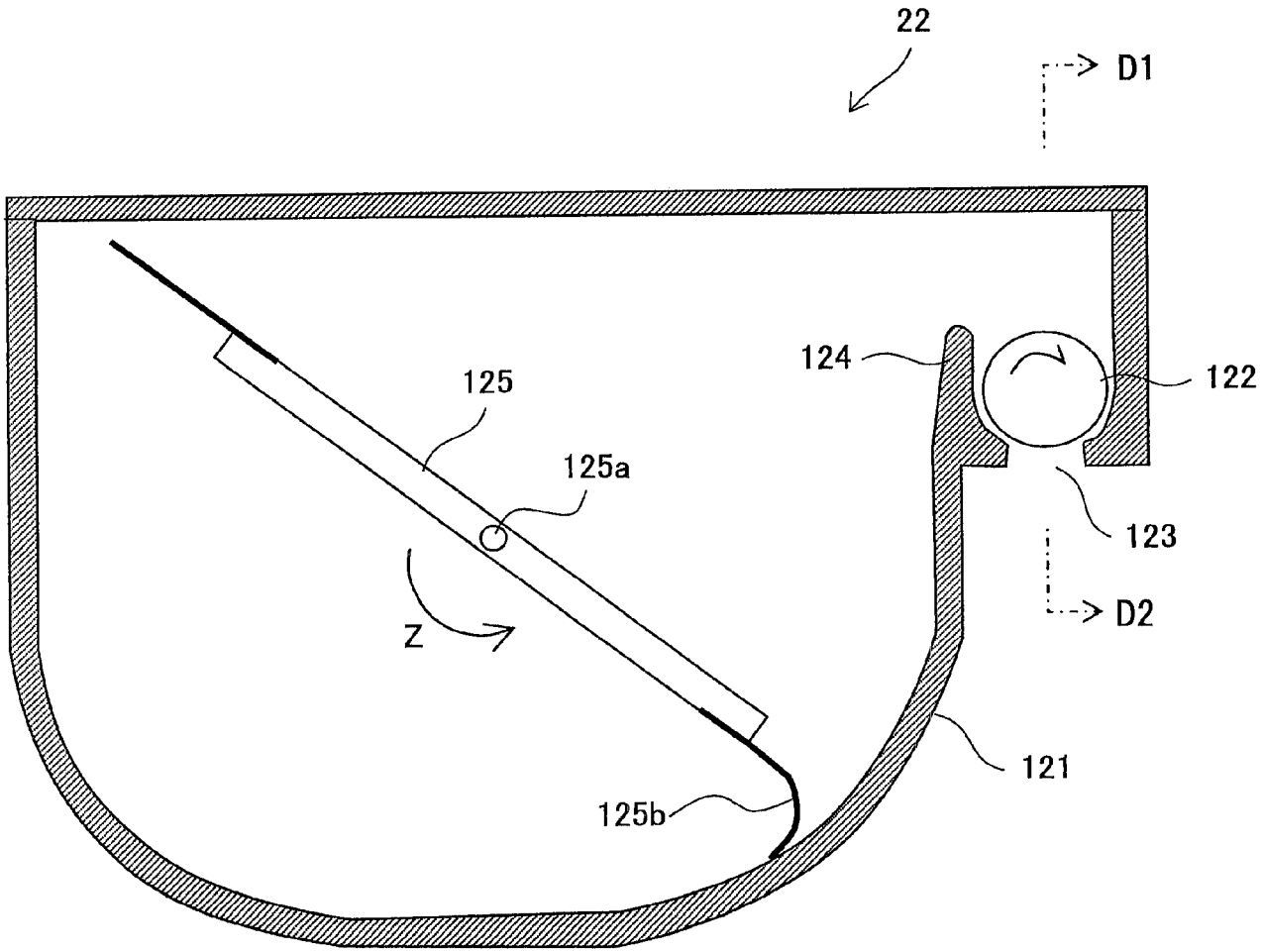
FIG. 2 is a sectional view showing a schematic configuration of a toner supply device that constitutes the image forming apparatus.
Figure 3:
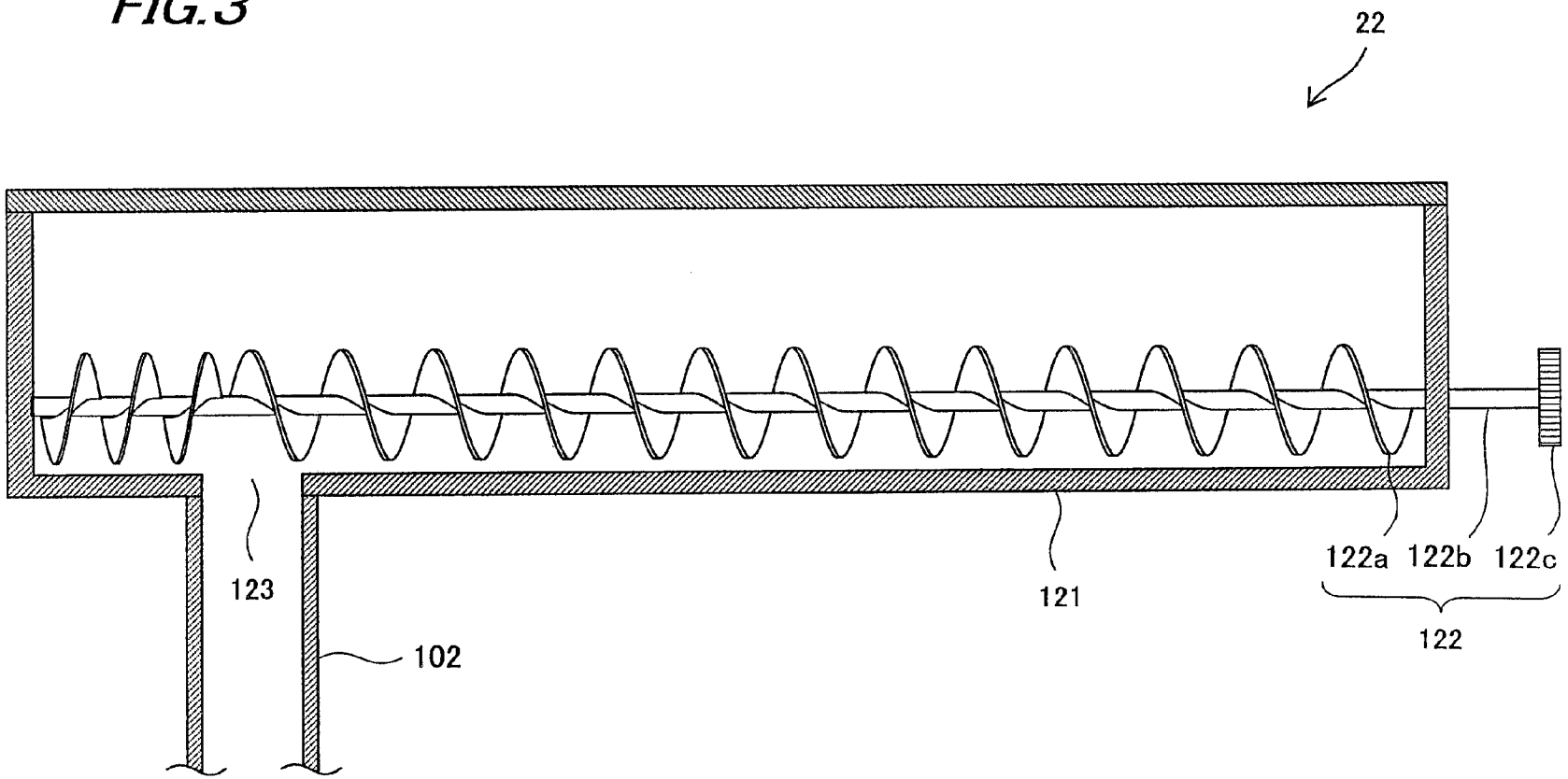
FIG. 3 is a sectional view cut along a plane D1-D2 in FIG. 2.

FIG. 2 is a sectional view showing a schematic configuration of the toner supply device that constitutes the image forming apparatus according to the present embodiment. FIG. 3 is a sectional view cut along a plane D1-D2 in FIG. 2.

As shown in FIGS. 2 and 3, toner supply device 22 includes a toner storing container 121, a toner agitator 125, a toner discharger 122 and a toner discharge port 123. Toner supply device 22 is arranged on the upper side of developing vessel 111 (FIG. 1) and stores unused toner (powdery toner). The toner in toner supply device 22 is supplied from toner discharge port 123 to developing vessel 111 (FIG. 1) by means of toner transport mechanism 102 (FIG. 1) as toner discharger (discharging screw) 122 is rotated.

Toner storing container 121 is a container part that has a substantially semicylindrical configuration with a hollow interior, supports toner agitator 125 and toner discharger 122 in a rotatable manner and stores toner. As shown in FIG. 3, toner discharge port 123 is a substantially rectangular opening disposed under toner discharger 122 and positioned near to the center with respect to the direction of the axis (the axial direction: longitudinal direction) of toner discharger 122 so as to oppose toner transport mechanism 102.

Toner agitator 125 is a plate-like part that rotates about a rotary axis 125*a* as shown in FIG. 2 and draws up and conveys the toner stored inside toner storing container 121 toward toner discharger 122 whilst agitating the toner. Toner agitator 125 has toner scooping parts 125*b* at both the ends thereof. Toner scooping part 125*b* is formed of a polyethylene terephthalate (PET) sheet having flexibility and is attached to either end of toner agitator 125.

Figure 8:
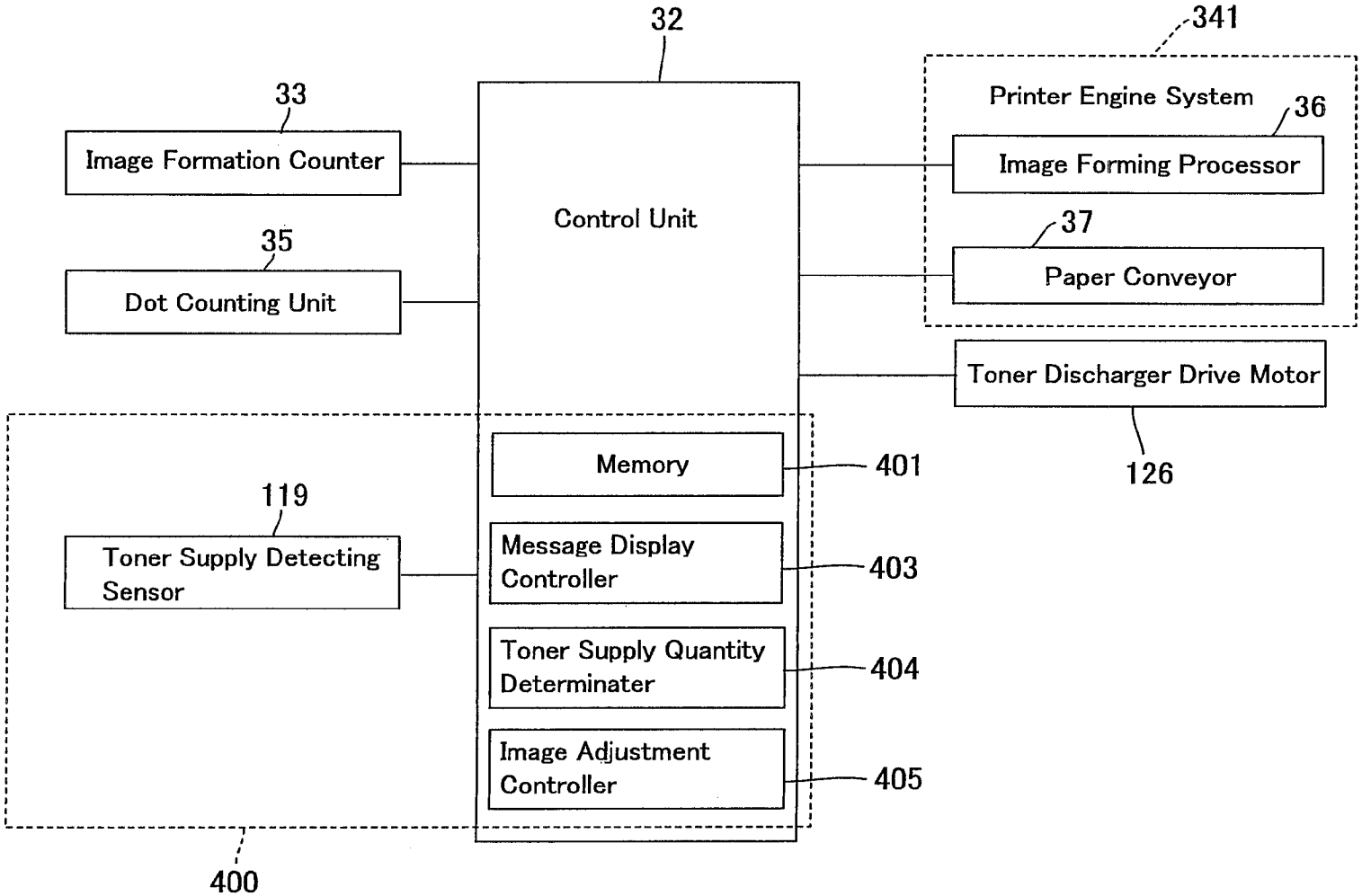
FIG. 8 is a block diagram showing a control system configuration in the image forming apparatus.

Toner discharger 122 dispenses the toner in toner storing container 121 from toner discharge port 123 to developing vessel 111, and is formed of a screw auger having a toner conveyor blade 122*a* and a toner discharger rotary shaft 122*b* and a toner discharger rotating gear 122*c*, as shown in FIG. 3. Toner discharger 122 is rotationally driven by a toner discharger drive motor 126 (FIG. 8). As to the helix direction of the screw auger, the blade is formed so that toner can be conveyed from both ends of toner discharger 122 toward toner discharge port 123.

Provided between toner discharger 122 and toner agitator 125 is a toner discharger partitioning wall 124. This wall makes it possible to keep and hold the toner scooped by toner agitator 125 in an appropriate amount around toner discharger 122.

As shown in FIG. 2, when toner agitator 125 rotates in the direction of arrow Z to agitate and scoop up the toner toward toner agitator 122, toner scooping parts 125*b* rotate as they are deforming and sliding over the interior wall of toner storing container 121 due to the flexibility thereof, to thereby supply the toner toward the toner discharger 122 side. Then, toner discharger 122 turns so as to lead the supplied toner to toner discharge port 123.

Next, the configuration of image forming apparatus 100 will be described with reference to the drawings.

Figure 4:
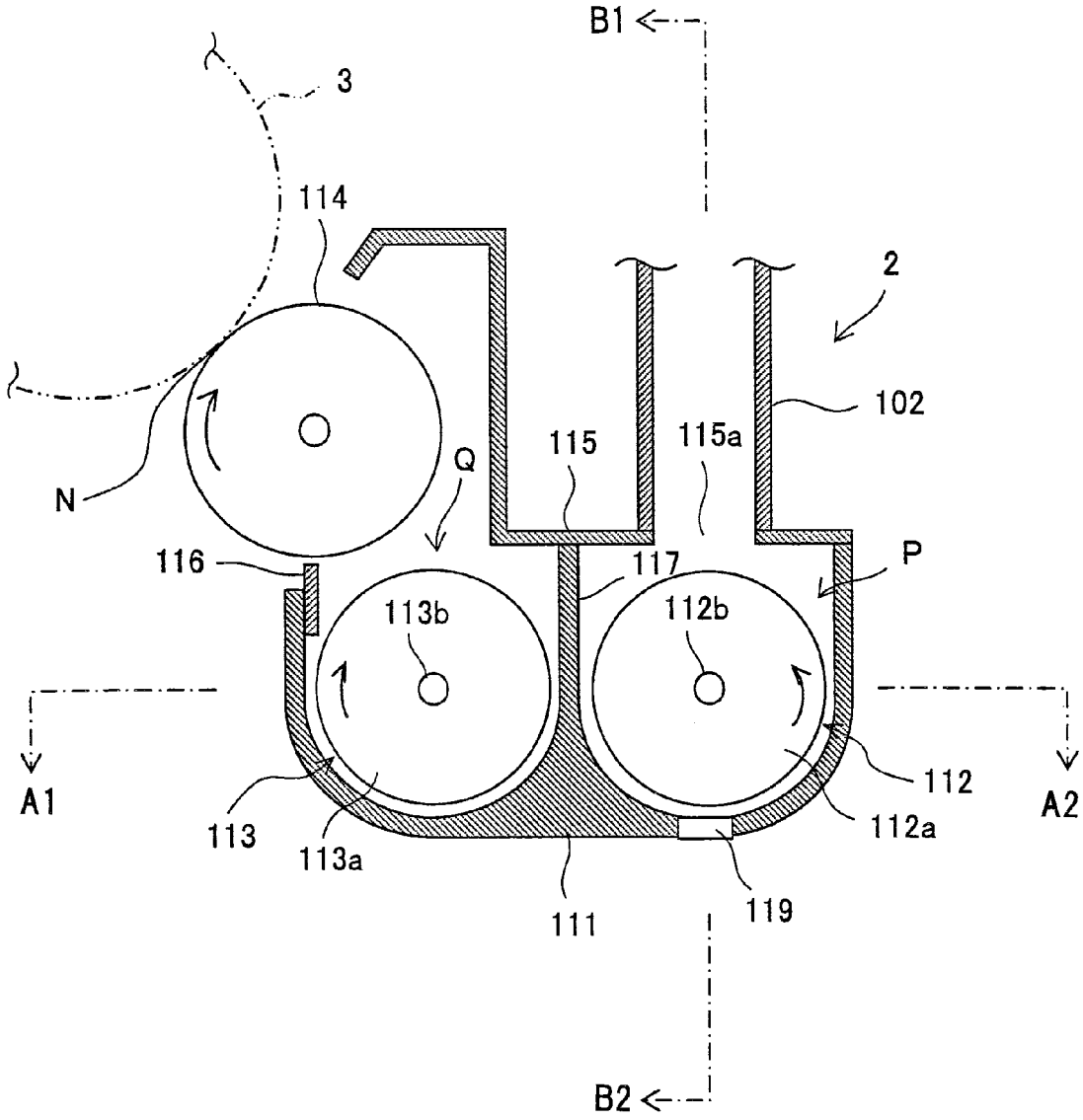
FIG. 4 is a sectional view showing a configuration of a developing device that constitutes the image forming apparatus.
Figure 5:
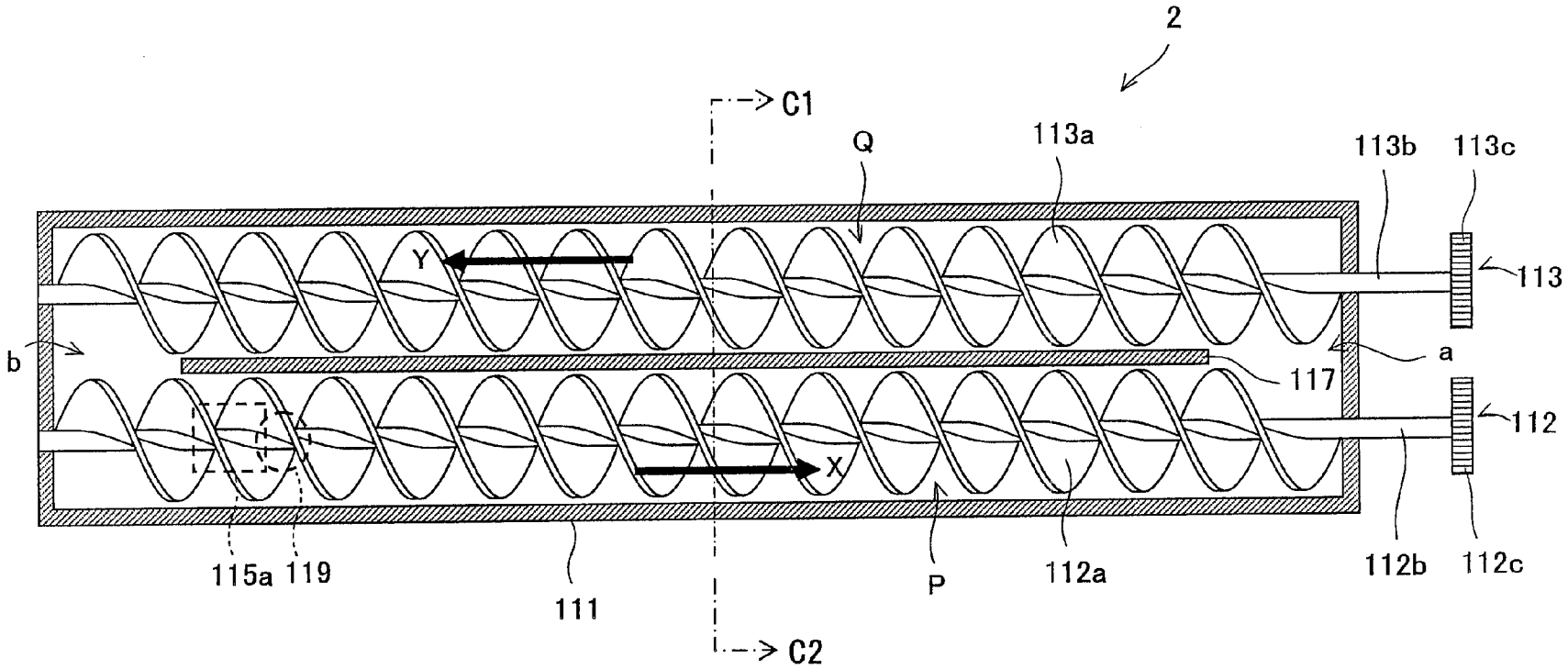
FIG. 5 is a sectional view cut along a plane A1-A2 in FIG. 4.
Figure 6:
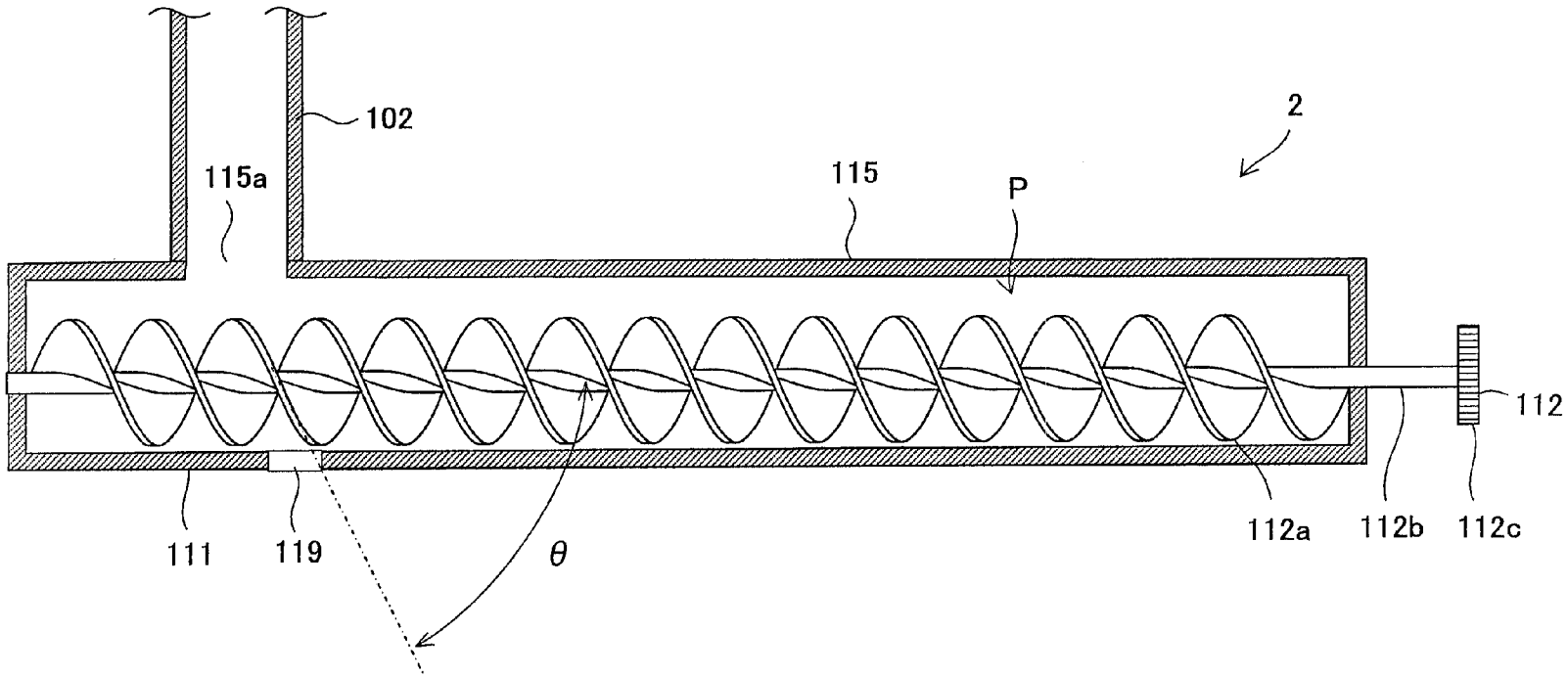
FIG. 6 is a sectional view cut along a plane B1-B2 in FIG. 4.
Figure 7:
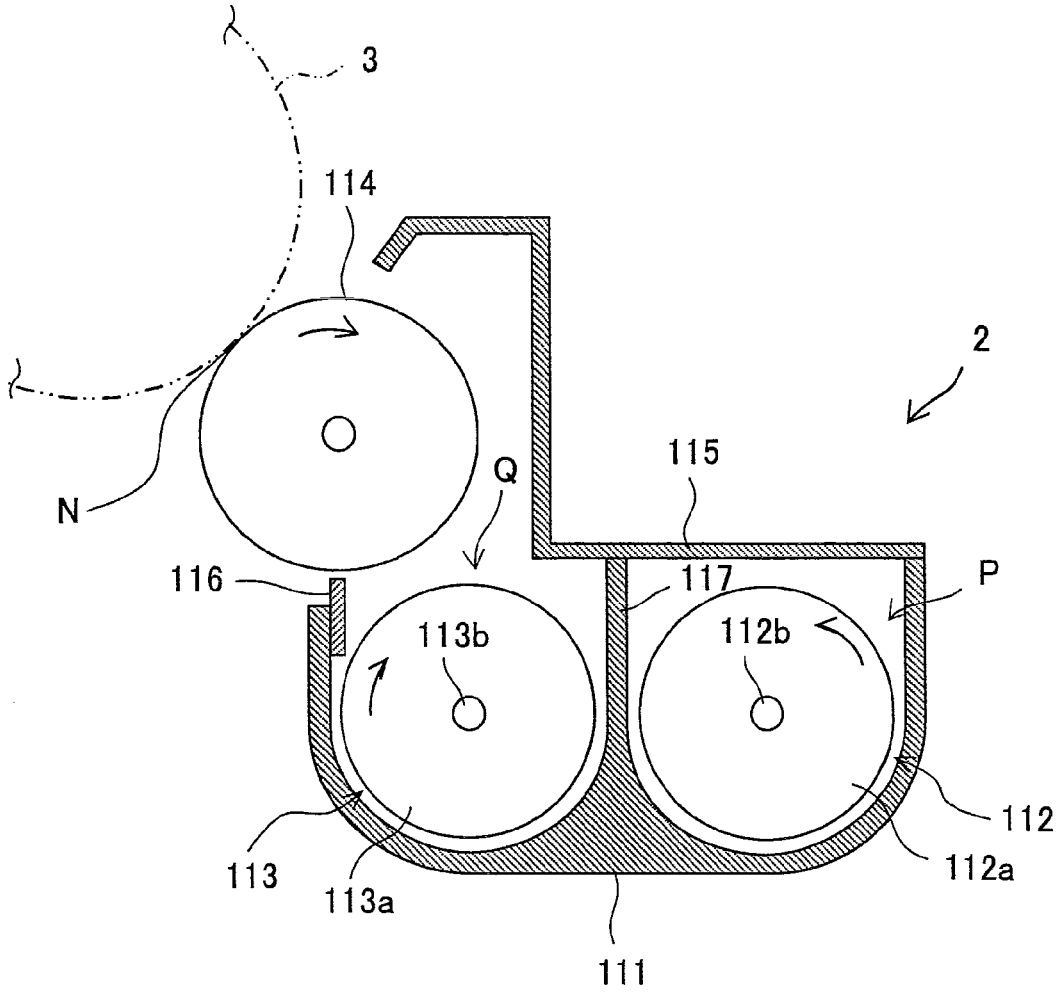
FIG. 7 is a sectional view cut along a plane C1-C2 in FIG. 5.

FIG. 4 is a sectional view showing the configuration of a developing device that constitutes the image forming apparatus according to the present embodiment, FIG. 5 is a sectional view cut along a plane A1-A2 in FIG. 4, FIG. 6 is a sectional view cut along a plane B1-B2 in FIG. 4, and FIG. 7 is a sectional view cut along a plane C1-C2 in FIG. 5.

Image forming apparatus 100 of the present embodiment includes: as shown in FIGS. 1 and 4, developing device 2 having a toner supply port 115*a* through which supplied toner is input into developing vessel (developer container) 111 for storing the developer; toner supply device 22 for supplying toner to developing device 2; a toner supply detecting sensor 119 for detecting whether toner is supplied into the developer container; and control unit (toner concentration controller) 32(FIG. 8) that instructs toner supply device 22 to supply toner to developing device 2 when the toner concentration of the developer in developing device 2 is lower than a predetermined set level.

Control unit 32 also functions as a toner empty determinater 400 (see FIG. 8) that determines that the toner in toner supply device 22 is used up when toner supply detecting sensor 119 does not detect any effect of toner supply after a toner supply command was given.

To begin with, developing device 2 will be described with reference to the drawings.

As shown in FIG. 4, developing device 2 has a developing roller (developer bearer) 114 arranged inside developing vessel 111 so as to oppose photoreceptor drum 3 and supplies toner from developing roller 114 to which a developing potential (developing bias) is applied, to the photoreceptor drum 3 surface to visualize (develop) the electrostatic latent image formed on the surface of photoreceptor drum 3. In this developing device 2, the amount of toner to be supplied to the photoreceptor drum 3 surface can be controlled by adjusting the developing potential (developing bias), whereby it is possible to control the density of a toner image formed on a recording medium such as paper or the like.

As shown in FIGS. 4 to 7, developing device 2 includes, other than developing roller 114, developing vessel 111, a developing vessel cover 115, toner supply port 115*a*, a doctor blade 116, a first conveying member 112, a second conveying member 113, a partitioning plate (partitioning wall) 117 and toner supply detecting sensor 119.

Developing vessel 111 is a container for holding a dual-component developer that contains a toner and a carrier (which will be simply referred to hereinbelow as "developer"). Developing vessel 111 includes developing roller 114, first conveying member 112, second conveying member 113 and the like. Here, the carrier of the present embodiment is a magnetic carrier presenting magnetism.

Arranged on the top of developing vessel 111 is removable developing vessel cover 115, as shown in FIGS. 4 and 6. This developing vessel cover 115 is formed with toner supply port 115*a* for supplying unused toner into developing vessel 111.

Arranged between first conveying member 112 and second conveying member 113 in developing vessel 111 is partitioning plate 117, as shown in FIGS. 4 and 5. Partitioning plate 117 is extended parallel to the axial direction (the direction in which each rotary axis is laid) of first and second conveying members 112 and 113. The interior of developing vessel 111 is divided by partitioning plate 117 into two sections, namely, a first conveying passage P with first conveying member 112 therein and a second conveying passage Q with second conveying member 113 therein.

Partitioning plate 117 is arranged so that its ends, with respect to the axial direction of first and second conveying members 112 and 113, are spaced from respective interior wall surfaces of developing vessel 111 (FIG. 5). Hereby, developing vessel 111 has communicating paths that establish communication between first conveying passage P and second conveying passage Q at around both axial ends of first and second conveying members 112 and 113. In the following description, as shown in FIG. 5, the communicating path formed on the downstream side with respect to the direction of arrow X is named first communicating path a and the communicating path formed on the downstream side with respect to the direction of arrow Y is named second communicating path b.

First conveying member 112 and second conveying member 113 are arranged so that their axes are parallel to each other with their peripheral sides opposing each other across partitioning plate 117, and are rotated in opposite directions. That is, as shown in FIG. 5, first conveying member 112 conveys the dual-component developer in the direction of arrow X while second conveying member 113 conveys the developer in the direction of arrow Y, which is the opposite to the direction of arrow X.

As shown in FIG. 5, first conveying member 112 is composed of a screw auger formed of a first helical conveying blade 112*a* and a first rotary shaft 112*b*, and a gear 112*c*. As shown in FIG. 5, second conveying member 113 is composed of a screw auger formed of a second helical conveying blade 113*a* and a second rotary shaft 113*b*, and a gear 113*c*. First and second conveying members 112 and 113 are rotationally driven by toner discharger drive motor 126 (FIG. 8) to agitate and convey the developer.

As shown in the sectional view of FIG. 6, first conveying member 112 is formed so that the angle formed between first rotary shaft 112*b* and the peripheral edge of first conveying blade 112*a*, or the inclined angle θ of the helical blade, falls within the range of 30 degrees to 60 degrees.

Specifically, when the inclined angle θ of the helical blade of first conveying member 112 is equal to or greater than 30 degrees and equal to or smaller than 60 degrees, the force of first conveying member 112 for agitating the developer in the rotational direction is so strong that the so-called "floating toner", the supplied toner being conveyed floating over the developer, is unlikely to occur. Accordingly, it is possible for toner supply detecting sensor 119 to detect toner concentration of the developer with precision even after toner supply.

On the other hand, when the inclined angle θ of the helical blade is less than 30 degrees, the speed of the developer being conveyed by first conveying member 112 is low so that the developer is abraded quickly. When the inclined angle θ of the helical blade exceeds 60 degrees, the speed of the developer being conveyed by first conveying member 112 becomes so high that the floating toner phenomenon is prone to occur.

Developing roller 114 (FIG. 4) is a magnet roller which is rotationally driven about its axis by an unillustrated driver, and draws up and carries the developer in developing vessel 111 on the surface thereof to supply toner included in the developer supported on the surface thereof to photoreceptor drum 3.

The developer conveyed by developing roller 114 comes in contact with photoreceptor drum 3 in the area where the distance between developing roller 114 and photoreceptor drum 3 becomes minimum. This contact area is called a developing nip portion N (FIG. 4). Application of a developing bias to developing roller 114 from an unillustrated power source that is connected to developing roller 114 causes toner to transfer from the developer on the developing roller 114 surface to the electrostatic latent image on the photoreceptor drum 3 surface, in developing nip portion N.

Arranged close to the surface of developing roller 114 is a doctor blade (layer thickness limiting blade) 116.

Doctor blade 116 is a rectangular plate-shaped member that is extended parallel to the axial direction of developing roller 114, disposed vertically below developing roller 114 and supported along its longitudinal side by developing vessel 111 so that its opposite longitudinal side is spaced from the developing roller 114 surface. This doctor blade 116 may be made of stainless steel, or may be formed of aluminum, synthetic resin or the like.

Concerning the attachment of toner supply detecting sensor 119, with regard to the horizontal direction (developer conveying direction), the sensor is attached at a position near and on the downstream side of toner supply port 115*a* with respect to the developer conveying direction (the direction of arrow X) while with regard to the vertical direction, the sensor is attached on the base of developing vessel 111 vertically below first conveying member 112, as shown in FIGS. 4 to 6. That is, toner supply detecting sensor 119 is attached to the base of first conveying passage P with its sensor face exposed to the interior of developing vessel 111.

Toner supply detecting sensor 119 is electrically connected to controller 32 (FIG. 8). Toner supply detecting sensor 119 may use general-purpose detecting sensors. Examples include transmitted light detecting sensors, reflected light detecting sensors, magnetic permeability detecting sensors, etc. Of these, magnetic permeability detecting sensors are preferable.

The magnetic permeability detecting sensor is connected to an unillustrated power supply. This power supply applies to the magnetic permeability detecting sensor the drive voltage for driving the magnetic permeability detecting sensor and the control voltage for outputting the detected result of toner concentration to the control device. Application of voltage to the magnetic permeability detecting sensor from the power supply is controlled by the control device. The magnetic permeability detecting sensor is a sensor of a type that receives application of a control voltage and outputs the detected result of toner concentration as an output voltage. Basically, the sensor is sensitive in the middle range of the output voltage, so that the applied control voltage is adjusted so as to produce an output voltage around that range. Magnetic permeability detecting sensors of this kind are found on the market, examples including TS-L, TS-A and TS-K (all of these are trade names of products of TDK Corporation).

Now, conveyance of the developer in the developing vessel of developing device 2 will be described.

As shown in FIGS. 1 and 5, the toner stored in toner supply device 22 is transported into developing vessel 111 by way of toner transport mechanism 102 and toner supply port 115*a*, whereby toner is supplied to developing vessel 111.

In developing vessel 111, first conveying member 112 and second conveying member 113 are rotationally driven by toner discharger drive motor 126 (FIG. 8) to convey the developer. More specifically, in first conveying passage P, the developer is agitated and conveyed in the direction of arrow X by first conveying member 112 to reach first communicating path a. The developer reaching first communicating path a is conveyed through first communicating path a to second conveying passage Q.

On the other hand, in second conveying passage Q, the developer is agitated and conveyed in the direction of arrow Y by second conveying member 113 to reach second communicating path b. Then, the developer reaching second communicating path b is conveyed through second communicating path b to first conveying passage P.

That is, first conveying member 112 and second conveying member 113 agitate the developer while conveying it in opposite directions.

In this way, the developer is circulatively moving in developing vessel 111 along first conveying passage P, first communicating path a, second conveying passage Q and second communicating path b, in this mentioning order. In this arrangement, the developer is carried and drawn up by the surface of rotating developing roller 114 while being conveyed in second conveying passage Q, and the toner in the drawn up developer is continuously consumed as transferring to photoreceptor drum 3.

In order to compensate for this consumption of toner, unused toner is supplied from toner supply port 115*a* to the first conveying passage P. The thus supplied toner is agitated and mixed in first conveying passage P with the previously existing developer.

Next, the toner concentration control method (process) and toner empty determinater 400 in image forming apparatus 100 will be described in a detailed manner.

The toner concentration control method may use a general method. For example, a control method using a toner concentration detecting sensor, a control method based on patch image density, a control method based on dot counting, and the like can be considered. Of these, the control method based on dot counting is preferable.

As shown in FIG. 8, image forming apparatus 100 includes a dot counting unit (dot counter) 35 for counting dots of data for image data to be transmitted to exposure unit 1.

Controller (toner concentration controller) 32 for making toner concentration control instructs toner supply device 22 to supply toner to developing device 2 in accordance with the count of dots of data from dot counting unit 35.

If toner supply detecting sensor 119 does not detect any toner supply after toner supply device 22 has been directed to supply toner to developing device 2, control unit 32 determines that no toner has been supplied from toner supply device 22 to developing device 2, or that no toner remains in toner supply device 22 (toner empty).

Now, the control system of image forming apparatus 100 will be described based on a block diagram.

As shown in FIG. 8, image forming apparatus 100 includes an image formation counter 33 for counting the total number of image forming operations, dot counting unit 35 for detecting the total count of pixels of an image formed on photoreceptor drum 3, toner supply detecting sensor 119 for detecting the magnetic permeability of the developer near the toner supply port, a printer engine system 341 including an image forming processor 36 and a paper conveyor 37, a toner discharger drive motor 126 for driving toner discharger 122 that supplies toner to developing vessel 111 and control unit 32 for controlling these.

In image forming apparatus 100, toner concentration control is mainly carried out by means of dot counting unit 35, control unit 32 and toner discharger drive motor 126, as shown in FIG. 8.

Dot counting unit 35 is to detect the total number of pixels of images (electrostatic latent images) formed correspondingly to the printed images on photoreceptor drum 3, and calculates the sum total of the pixels of images to be printed and the pixels of images that have been printed heretofore as a dot count value. The thus calculated dot count value is recorded into memory 401 of control unit 32. From the dot count value, detected (calculated) by dot counting unit 35, the amount of toner consumed for image forming can be estimated.

Control unit 32 determines the amount of toner to be consumed for the current image forming based on the dot count value and controls rotational driving of toner discharger drive motor 126 in accordance with the determined amount of toner. For example, control unit 32 transmits a toner supply command to toner supply device 22 when it determines that the toner concentration in developing device 2 has become lower than a predetermined standard level so as to control toner discharger drive motor 126. Here, the method of detecting toner concentration is not particularly limited.

In this way, toner corresponding to the amount of toner consumed from developing device 2 (developing vessel 111) is supplied from toner supply device 22 into developing device 2 (developing vessel 111).

In image forming apparatus 100, toner empty determiner 400 is mainly configured of toner supply detecting sensor 119 and control unit 32, as shown in FIG. 8.

Control unit (toner concentration controller) 32 includes: as shown in FIG. 8, memory 401, a message display controller 403, a toner supply quantity determinater 404 and image quality adjustment controller 405 to provide the function of toner empty determinater 400 in addition to the above-described functionality.

Memory 401 records the difference or ratio between the outputs from toner supply detecting sensor 119 before and after toner supply from toner supply device 22.

Message display controller 403 performs control for displaying a message that gives notice of toner empty of toner supply device 22 when the amount of toner supply has become equal to or lower than the first supply reference value or a message that recommends replacement of toner supply device 22, on a display portion (not shown).

Toner supply quantity determinater 404 determines that the amount of toner remaining in toner supply device 22 is low and the amount of toner supply is low when the difference or ratio between the outputs from toner supply detecting sensor 119 before and after toner supply from toner supply device 22 (which will be briefly written hereinbelow as "toner supply quantity evaluation index") is smaller than the second supply reference value and greater than the first supply reference value. Here, the second supply reference value is a value greater than the first supply reference value.

The range smaller than the second supply reference value and greater than the first supply reference value will be briefly written hereinbelow as "supplied quantity decreased range".

The first and second supply reference values, that is, the supplied quantity decreased range, are previously stored in the memory 401.

When the toner supply quantity evaluation index falls within the supplied quantity decreased range, image quality adjustment controller 405 adjusts (changes) the timing for implementing the process control as to the potential adjustment (adjustment in developing potential and/or charging potential) for controlling the density of the toner image formed on the photoreceptor drum 3 (which will be referred to hereinbelow as "potential adjustment process control"), in conformity with the toner supply quantity evaluation index.

That is, in the case where the potential adjustment standard timing such as times, duration, interval and the like for implementing the potential adjustment process control has been previously designated, if the toner supply quantity evaluation index is determined to fall within the supplied quantity decreased range, the interval up to the next implementation of the potential adjustment process control is set shorter than the potential adjustment standard interval.

The shortened timing of implementing the next potential adjustment process control includes the timing at which the toner supply quantity evaluation index was determined to be within the supplied quantity decreased range and the shortened timing of the potential adjustment standard interval.

The potential adjustment standard interval has been previously set at the memory 401.

The method of shortening the potential adjustment standard interval may use any technique and is not particularly limited.

In the present embodiment, control unit 32 is adapted to continuously monitor the toner concentration of the developer in developing vessel 111 through toner supply detecting sensor 119, and if toner supply detecting sensor 119 has not detected any effect of toner supply even after a toner supply command was given, the control unit determines the status of toner to be that of empty. Furthermore, when the toner supply quantity evaluation index has become equal to or lower than the first supply reference value, the control unit 32 determines the status of toner to be that of empty.

Next, toner supply to developing device 2 in image forming apparatus 100 will be described.

Figure 9:
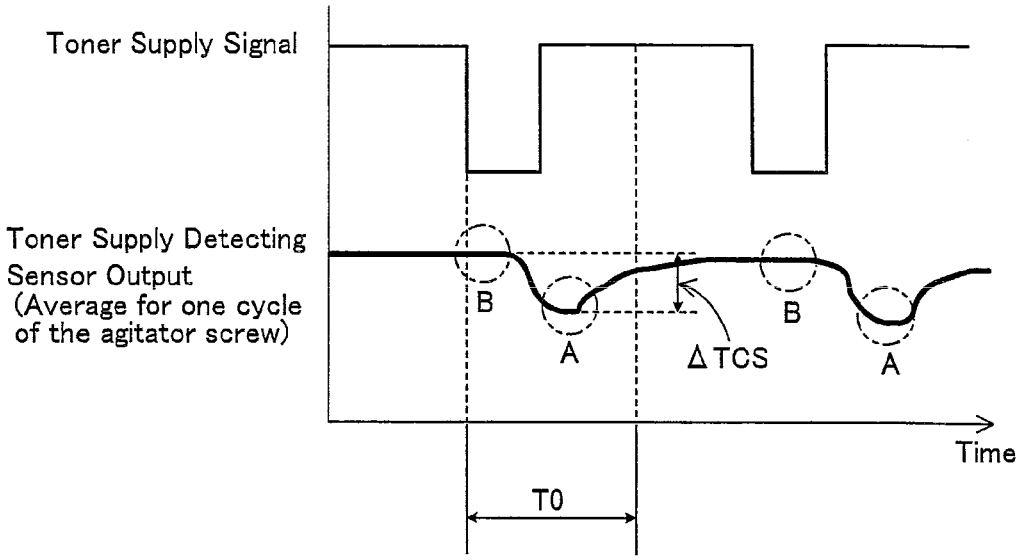
FIG. 9 is a graph showing the relationship between a toner supply signal indicating a toner supply from the toner supply device and the output from a toner supply detecting sensor; and, FIG. 10 is a graph showing a relationship between the difference between the output values from a toner supply detecting sensor before and after a toner supply from the toner supply device and total toner supply time.
Figure 10:
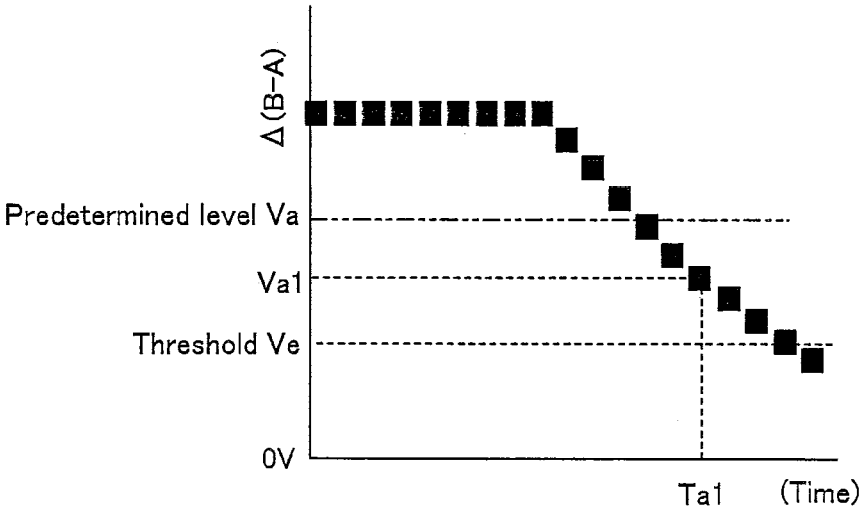

FIG. 9 is a graph showing the relationship between a toner supply signal indicating a toner supply from the toner supply device and the output from the toner supply detecting sensor according to the present embodiment. FIG. 10 is a graph showing a relationship between the difference between the output values from the toner supply detecting sensor before and after a toner supply from the toner supply device and total toner supply time.

Toner supply to developing device 2 in image forming apparatus 100 is performed from toner supply device 22 to developing device 2 by control unit 32, which directs toner supply device 22 to supply toner to developing device 2 when the toner concentration of the developer in developing vessel 111 of developing device 2 has lowered and becomes lower than a predetermined level.

Toner supply into developing vessel 111 is detected by toner supply detecting sensor 119. Since toner supply detecting sensor 119 is disposed on the base in the first conveying passage P under toner supply port 115*a*, if toner is added to the developer from toner supply port 115*a*, it is possible to promptly detect change of the magnetic permeability of the developer. That is, it is possible to immediately recognize whether or not toner supply from toner supply device 22 is done.

Accordingly, if toner supply detecting sensor 119 does not detect any change of the magnetic permeability of the developer even after a toner supply command was given from control unit 32 to toner supply device 22, it is possible to determine that no toner supply from toner supply device 22 has been made. In other words, controller 32 immediately up (toner empty).

For example, when the sensor outputs from toner supply detecting sensor 119 before and after toner supply are given as B and A, respectively, the output difference Δ(B−A) is calculated for each operation of toner supply, as shown in FIG. 9.

Specifically, in image forming apparatus 100, the output value from toner supply detecting sensor 119 is continuously monitored as the average in one cycle of helical conveying blade 112*a*, as shown in FIG. 9.

Then, immediately after a command (toner supply signal) is given to toner discharger drive motor 126 so as to cause discharger 122 of toner supply device 22 to rotate, the average output value from toner supply detecting sensor 119 is sampled for a predetermined period of time.

In FIG. 9, T0 represents the sampling time for detecting toner concentration by toner supply detecting sensor 119. In the toner supply signal shown in the upper part of FIG. 9, the high level represents the OFF state while the low level represents the ON state.

Controller 32 calculates the difference Δ(B−A) ("ΔTCS" in FIG. 9) between the sensor output values before and after a toner supply, where the maximum and minimum values of the sampling data by toner supply detecting sensor 119 in sampling time T0 are denoted as B and A, respectively. Then, controller 32 calculates the difference Δ(B−A) between the sensor output values before and after a toner supply every time toner discharger drive motor 126 starts operating, and records the calculated output difference Δ(B−A) into memory 401.

That is, since there is a time lag from the start of toner supply based on the generation of the toner supply signal up to detection of toner supply by toner supply detecting sensor 119, the maximum value B is a sensor output value before a toner supply and the minimum value A is a sensor output value after the toner supply. Accordingly, it is necessary to select such a sampling time T0 as to be able to detect both the maximum value B and the minimum value A, taking the time lag into consideration.

As shown in FIG. 10, when toner supply device 22 has a sufficient amount of toner left, a large amount of toner falls in a stable manner. Hence the output difference Δ(B−A) presents a large value. On the other hand, when the remaining amount of toner is low, the output difference Δ(B−A) presents a small value, approaching to "0".

In FIG. 10, Va denotes the second supply reference value (level) for the amount of toner falling (the amount of toner supply) and Ve denotes the toner empty threshold or the first supply reference value (level). That is, the aforementioned supplied quantity decreased range is the range smaller than level Va and greater than level Ve.

When the aforementioned supply quantity evaluation index, i.e., the output difference Δ(B−A) becomes lower than the second supply reference value Va and further decreases to take an output difference Va1 in the supplied quantity decreased range at time Ta1, controller 32 detects the fact that the amount of toner falling (the amount of toner supply) is low and causes image quality adjustment controller 405 to implement the potential adjustment process control in a short interval in accordance with the output difference Δ(B−A).

That is, if the output difference Δ(B−A) takes a value in the supplied quantity decreased range, there is a possibility of insufficiency of toner supply occurring. Accordingly, when the output difference Δ(B−A) becomes lower than the second supply reference level Va, the interval up to the next implementation of the potential adjustment process control is made shorter than the interval of the time between adjustment of electrical potential adjustment standard interval as the output difference Δ(B−A) becomes smaller in the supplied quantity decreased range. Since this arrangement makes it possible to execute image quality adjustment (image density adjustment) before the density of the toner image formed on the recording medium such as paper etc., lowers, it is possible to inhibit lowering of image density.

Further, toner empty determinater 400 makes a toner empty determination when the output difference Δ(B−A) from toner supply detecting sensor 119 is lower than the toner empty threshold (the first supply reference value) Ve.

Though in the present embodiment the output difference Δ(B−A) is used in order to detect a change in the output from toner supply detecting sensor 119, a ratio (B/A) may also be used instead of the output difference Δ(B−A).

Alternatively, decision for shortening the interval up to the next implementation of potential adjustment process control may be made when the average of multiple toner supply quantity evaluation indexes falls within the supplied toner decreasing range, not limited to when only one toner supply quantity evaluation index falls within the supplied toner decreasing range.

Also, decision for shortening the interval up to the next implementation of potential adjustment process control may be made when a plurality of toner supply quantity evaluation indexes fall within the supplied toner decreasing range.

As described heretofore, according to the present embodiment, when the toner supply quantity evaluation index recorded in memory 401 falls within the predetermined supplied quantity decreased range, it is determined that toner supply device 22 holds a lower amount of residual toner and can supply only a lower amount of toner, and the interval up to the next implementation of potential adjustment process control is made shorter than the potential adjustment standard interval. With this arrangement, the potential adjustment process control is implemented before the density of the toner output image formed on the paper or other recording mediums lowers, so that it is possible to inhibit degradation of output images and lowering of the output image density due to carrier adherence resulting from reduction in toner concentration.

According to the present embodiment, since in image forming apparatus 100 toner supply detecting sensor 119 is disposed in the vicinity of toner supply port 115*a* of developing device 2 and on the bottom of first conveying passage P under toner supply port 115*a*, it is possible to promptly detect a change of the magnetic permeability when toner is supplied from toner supply device 22.

Accordingly, in a case where toner supply detecting sensor 119 has detected no change in magnetic permeability even when the toner concentration in the developer inside developing device 2 had become lower than the predetermined level and the toner concentration controller directed toner supply device 22 to supply toner, empty determiner 400 is able to promptly conclude that the toner in toner supply device 22 is used up (toner empty). As a result, it is possible to prevent the occurrence of carrier adherence to photoreceptor drum 3 due to a decrease in toner concentration when a toner image is formed on photoreceptor drum 3.

Further, since first conveying member 112 is constructed so that the inclined angle θ of the helical blade falls within the range from 30 degrees to 60 degrees, the force of agitating the developer in the rotational direction of first conveying member 112 becomes strong so that the so-called "floating toner", the added toner being conveyed floating over the developer, is unlikely to occur. Accordingly, it is possible for toner supply detecting sensor 119 to detect change in magnetic permeability of the developer with precision even after toner supply is carried out.

The above embodiment was described taking an example in which the image forming apparatus of the present invention is applied to image forming apparatus 100 shown in FIG. 1. However, as long as it is an image forming apparatus in which the toner concentration of the developer in the developing device is controlled by supplying toner from a toner supply device, the invention can be developed to any other image forming apparatus and the like, not limited to the image forming apparatus and copier having the configuration described above.

Having described heretofore, the present invention is not limited to the above embodiment, various changes can be made within the scope of the appended claims. That is, any embodied mode obtained by combination of technical means modified as appropriate without departing from the spirit and scope of the present invention should be included in the technical art of the present invention.

What is claimed is:

1. An image forming apparatus comprising:

a developing device;

a toner supply device;

a toner supply detecting sensor; and, a toner concentration controller, wherein the developing device comprises:

a developer container for storing a developer including a toner and a magnetic carrier;

a developer conveying structure disposed inside the developer container for circulatively conveying the developer whilst agitating;

a developing roller for supplying the toner included in the developer to a photoreceptor drum; and, a toner supply port that leads supplied toner into the developer container, the toner supply device supplies the toner into the developing device, the toner supply detecting sensor detects whether the toner has been supplied into the developer container, the toner concentration controller instructs the toner supply device to supply toner to the developing device when the toner concentration of the developer in the developing device has become lower than a predetermined reference concentration, the toner concentration controller determines that the toner in the toner supply device is empty when the toner supply detecting sensor has detected no toner supply after a command of toner supply was given, the toner concentration controller includes:

a memory that stores either the difference, or the ratio, between the outputs from toner supply detecting sensor before and after toner supply from the toner supply device, as a toner supply quantity evaluation index;

a toner supply quantity determinater that determines whether the toner supply quantity evaluation index is smaller than a predetermined supply reference value; and, an image quality adjustment controller that shortens the interval of time between adjustments of electrical potential for controlling the density of a toner image formed on the photoreceptor drum, when the toner supply quantity evaluation index is smaller than the supply reference value.

2. The image forming apparatus according to claim 1, wherein the image quality adjustment controller shortens the interval of time between adjustments of electrical potential when the average of a plurality of toner supply quantity evaluation indexes is smaller than the supply reference value or when a plurality of toner supply quantity evaluation indexes are smaller than the supply reference value.

3. The image forming apparatus according to claim 1, wherein the toner supply detecting sensor is disposed near the toner supply port in the developer container.

4. The image forming apparatus according to claim 1, wherein the toner supply detecting sensor detects the magnetic permeability of the developer in the developer container.

5. The image forming apparatus according to claim 1, wherein the developing device includes a first conveying passage and a second conveying passage that are sectioned by a partitioning wall in the developer container and arranged to communicate with each other at both ends of the partitioning wall, the developer conveying structure includes a first conveying member and a second conveying member that are arranged in the first convening passage and second conveying passage, respectively, agitate and circulatively convey the developer in the first conveying passage and in the second conveying passage, in opposite directions to each other, the developing device supplies the developer inside the second conveying passage to the photoreceptor drum by means of the developing roller, the toner supply port is disposed over the first conveying passage, and, the toner supply detecting sensor is disposed at the bottom of the first conveying passage under the toner supply port.

6. The image forming apparatus according to claim 5, wherein the first conveying member is a screw auger having a rotary shaft and a helical blade, and the helical blade is formed so that the inclined angle relative to the axial direction of the rotary shaft is specified to fall within the range of 30 degrees to 60 degrees.

7. The image forming apparatus according to claim 1, further comprising:

a dot counter for counting dots of data corresponding to image data to be transmitted to the exposure device for forming an electrostatic latent image on the photoreceptor drum surface, wherein the toner concentration controller instructs the toner supply device to supply toner to the developing device based on the count of the dots of data from the dot counter.

* * * * *